US006360447B1

(12) United States Patent
Foley

(10) Patent No.: US 6,360,447 B1
(45) Date of Patent: Mar. 26, 2002

(54) EMPTY ENVELOPE ASSURANCE APPARATUS AND METHOD

(75) Inventor: James E. Foley, Easton, CT (US)

(73) Assignee: Agissar Corporation, Stratford, CT (US)

( * ) Notice: Subject to any disclaimer, the term of this patent is extended or adjusted under 35 U.S.C. 154(b) by 0 days.

(21) Appl. No.: 09/552,976

(22) Filed: Apr. 20, 2000

Related U.S. Application Data

(60) Provisional application No. 60/130,887, filed on Apr. 23, 1999.

(51) Int. Cl.[7] ..... B07C 5/04

(52) U.S. Cl. ..... 33/501.02; 33/834; 33/501.05; 209/604; 209/900; 271/2; 271/259; 271/265.04; 53/504

(58) Field of Search ..... 33/501.02, 700, 33/701, 783, 832, 833, 834, 501.05, 679.1; 209/601, 604, 900; 271/2, 258.01, 259, 262, 265.04, 264, 265.01; 53/52, 493, 504

(56) References Cited

U.S. PATENT DOCUMENTS

| | | | | | |
|---|---|---|---|---|---|
| 3,919,779 | A | * | 11/1975 | Piggott | 33/501.02 |
| 3,979,884 | A | | 9/1976 | Russell | |
| 4,271,699 | A | * | 6/1981 | Williamson | 33/501.02 |
| 4,576,287 | A | * | 3/1986 | Bingham et al. | 209/601 |
| RE32,328 | E | | 1/1987 | Russell | |
| 4,934,892 | A | | 6/1990 | Smith et al. | |
| 5,131,545 | A | * | 7/1992 | Owen | 209/604 |
| 5,134,834 | A | | 8/1992 | Hayduchok | |
| 5,575,078 | A | * | 11/1996 | Moulton, III | 33/501.02 |
| 5,727,692 | A | * | 3/1998 | Large et al. | 209/604 |
| 6,145,211 | A | * | 11/2000 | Typpo et al. | 33/501.02 |
| 6,230,471 | B1 | * | 5/2001 | Robertson et al. | 53/52 |

* cited by examiner

*Primary Examiner*—Christopher W. Fulton
(74) *Attorney, Agent, or Firm*—St. Onge Steward Johnson & Reens LLC

(57) ABSTRACT

An empty envelope assurance system is provided. The system includes a conveyor for conveying an opened envelope having a front face and a rear face along a path of movement. The conveyor is arranged such that any contents of the envelope rests against one of the front face or the rear face. A first sensor measures a thickness of the front face and any contents resting thereagainst, and generates a signal having a value indicative of the thickness. A second sensor measures a thickness of the rear face and any contents resting thereagainst, and generates a signal having a value indicative of the thickness. A signal processor receives the signals generated by the first sensor and the second sensor, and compares the values of the signals generated by the first sensor with the values of the signals generated by the second sensor to determine whether they correspond within a predetermined limit to determine whether the envelope contains any contents.

21 Claims, 4 Drawing Sheets

EMPTY ENVELOPE ASSURANCE APPARATUS AND METHOD

CLAIM OF PRIORITY

The present application claims the benefit of U.S. Provisional Application No. 60/130,887, filed Apr. 23, 1999.

FIELD OF THE INVENTION

The present invention relates to an apparatus and method for determining whether all of the contents of an envelope have been removed, and more particularly to such an apparatus and method which is particularly well-suited for use with envelopes having inconsistent style, color and size.

BACKGROUND OF THE INVENTION

One of the most crucial considerations for fast and efficient extraction of an envelope's contents from a large quantity of envelopes is verifying that envelopes passing through the system are in fact emptied of all their contents. Whether the contents of the envelope are extracted directly by an operator's hand or by other means (typically automated means), there is a possibility that some of the contents of the envelope, such as a check or an important document, will remain stuck to one side of the envelope even when the opposing faces of the envelope are spread apart. In some envelopes, the contents may have been inserted folded, and others not. In some envelopes, the contents may be bunched to one side, rather than neatly centered within the envelope. Obviously, the accidental discarding of checks must be avoided. Even the loss of documents, such as copies of invoices which accompany the checks, is clearly undesirable. For a recipient of a large quantity of checks, such as a utility or a credit card company, the resulting confusion and delay in document processing can be expensive.

In an attempt to remedy these problems, many systems have been developed which are designed to ensure that all of an envelope's contents have been removed. Examples of such systems include those disclosed in U.S. Pat. Nos. 3,979,884, 4,934,892 and U.S. Reissue Patent No. Re. 32,328. Each of these prior art systems operates by measuring the transmissivity of radiant energy, such as visible light, infrared light, or sound, through the envelope and any contents therein. In general principle, an empty envelope will allow a certain quantity of light to pass through to a photocell, while an envelope having documents remaining therein will allow a lesser quantity of light to pass through to the photocell. This lesser light transmissivity of an envelope still containing a document or documents is used to signal, through a control system, that the envelope then passing by the photocell still contains documents.

More specifically, each of the above described systems generally operates by using a fixed threshold value of light transmissivity, which threshold value is used to indicate the presence or absence of an empty envelope. When the intensity of the light passing through an envelope is above the threshold value, the envelope is deemed empty, and when this intensity is below the threshold value, the envelope is deemed to be not empty. As a result, the effectiveness of the apparatus is highly dependent on the exact value of the threshold in relation to the characteristics of the envelope being subjected to extraction. To allow for variation of the threshold value, prior art devices typically include an external knob which operates as a potentiometer.

Another prior art system designed to ensure that all of an envelope's contents have been removed is disclosed in U.S. Pat. No. 5,134,834. This prior art reference attempts to remedy a perceived disadvantage of prior art devices in that, no matter how carefully a threshold value is selected for identifying an empty envelope, there will nevertheless tend to be some error because a spread-open envelope which is actually empty may be observed to transmit less light than an envelope still having contents therein. The reference, therefore, attempts to more precisely define an appropriate threshold value by measuring the transmissivity of the envelope and contents when the envelope is unspread and then again after the envelope is spread, and calculating, based on the measured transmissivities of the envelope when spread and unspread, a threshold value of transmissivity consistent with the envelope being empty. After the empty envelope constant is obtained, the series of envelopes are processed. For each envelope in the series, the transmissivity is observed in two states: when the envelope is unspread, and then when the envelope is spread, but with the contents remaining therein. These observed transmissivities are then combined with the empty envelope constant to calculate a target value of transmissivity which would be consistent with a fully emptied envelope. This target value is then used as the threshold transmissivity value for determining when the particular envelope being opened has been emptied of all contents.

All of the prior art devices set forth above, however, suffer from disadvantages of their own. One of such disadvantages relates to the handling of "white" mail. Mixed mail, also known as "white" mail consists of envelopes that are inconsistent in style, color, and size. The contents in these envelopes are also inconsistent, containing various types of remittance and correspondence which vary in the number of pages, some of which are folded, the way in which pages are attached together, etc.

Known prior art devices are designed to handle bulk or remittance type mail, which are returned using identical standard envelopes, and cannot be used effectively to process white mail. This is true because all of the known prior art devices use a constant threshold value in order to determine whether or not an envelope is empty. This is true even of U.S. Pat. No. 5,134,834. Although this reference employs a somewhat more sophisticated analysis than the other prior art references described above, the system disclosed therein still employs an empty envelope constant which, once determined, is used in determining whether a series of envelopes is fully emptied.

Using such systems to determine whether white mail envelopes are empty provides inconsistent results at best. These systems cannot take into account all of the potential variations in envelope selection by the sender in a white mail situation. As such, comparing these envelopes having widely varying characteristics to predetermined threshold values or envelope constants is ineffective. For example, a very thin and light transmissive envelope containing a check may have light transmissivity identical to, or even greater than, a thick, light restrictive envelope which has been emptied. Prior art systems provide no mechanism for distinguishing the two cases from one another. As such, no reliable threshold could be set to assure that the emptied light restrictive envelope could be distinguished from the full light transmissive envelope.

What is desired, therefore, is an empty envelope assurance system which determines whether all of the contents of an envelope have been removed, which can be used to effectively and efficiently process white mail having envelopes that are inconsistent in style, color, and size, and which is dependent upon the characteristics of the envelope itself rather than predetermined threshold values or constants.

SUMMARY OF THE INVENTION

Accordingly, it is an object of the present invention to provide an empty envelope assurance system which determines whether all of the contents of an envelope have been removed.

Another object of the present invention is to provide an empty envelope assurance system having the above characteristics and which can be used to effectively and efficiently process white mail having envelopes that are inconsistent in style, color, and size.

A further object of the present invention is to provide an empty envelope assurance system having the above characteristics and which is dependent upon the characteristics of the envelope itself rather than predetermined threshold values or constants.

These and other objects of the present invention are achieved by provision of an empty envelope assurance system which includes a conveyor for conveying an opened envelope having a front face and a rear face along a path of movement. The front face and the rear face of the envelope each define a plurality of zones, and the conveyor is arranged such that any contents of the envelope rests against either the front face or the rear face. A first sensor measures a thickness of the front face and any contents resting thereagainst at a plurality of locations in each zone, and generates a signal having a value indicative of the thickness at each location. A second sensor measures a thickness of the rear face and any contents resting thereagainst at a plurality of locations in each zone, and generates a signal having a value indicative of the thickness at each location.

A signal processor receives the signals generated by the first sensor and the second sensor, averages the values of the signals generated by the first sensor at each location to determine an average value indicative of the thickness at each zone of the front face and averages the values of the signals generated by the second sensor at each location to determine an average value indicative of the thickness at each zone of the rear face. Next, the signal processor averages the values of the zones of the front face to determine a value indicative of the thickness of the front face and averages the values of the zones of the rear face to determine a value indicative of the thickness of the rear face. Finally, the signal processor compares the value indicative of the thickness of the front face with the value indicative of the thickness of the rear face to determine whether they correspond within a predetermined limit to determine whether the envelope contains any contents.

The invention and its particular features and advantages will become more apparent from the following detailed description considered with reference to the accompanying drawings.

DETAILED DESCRIPTION OF THE INVENTION

Figure 1:
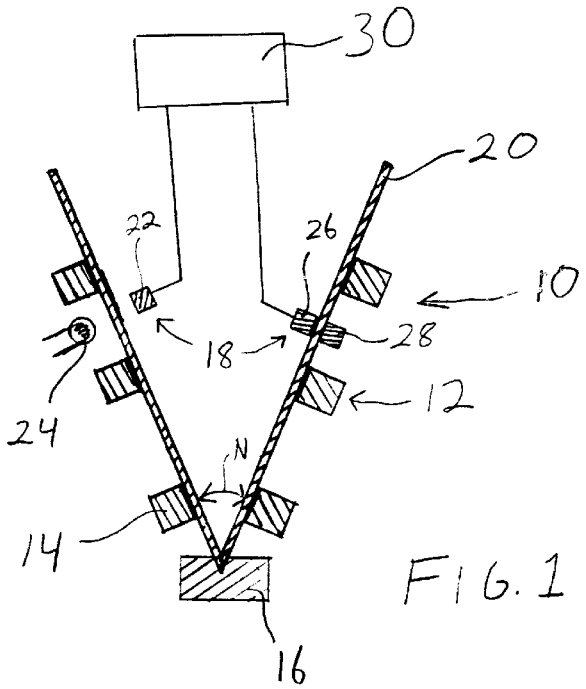
FIG. 1 is a partially cross-sectional view of an empty envelope assurance system in accordance with the present invention having an empty envelope disposed therein.

Referring first to FIG. 1, an empty envelope assurance system 10 is shown. System 10 includes a conveyor 12, which may take any of numerous forms, such as a series of rollers 14 and a stationary guide 16, as is illustrated in the Figure. It should be understood that the configuration of conveyor 12 is not material to the novelty of the present invention, and is, therefore, not described in detail herein. Other examples of conveyors which may be substituted for the illustrated rollers 14 include systems based on movable belts or pneumatic pressure.

System 10 also includes at least two thickness sensors 18 which are positioned along conveyor 12 such that at least one thickness sensor 18 measures each of the front and rear faces of an opened envelope 20 traveling in conveyor 12. Envelope 20 has been opened along at least three of the four edges, either manually or automatically using an automatic opener (not shown). Preferably, conveyor 12 is arranged such that opened envelope 20 travels therein in a V-shaped configuration, with the front face and rear face of envelope 20 having a relative angle N therebetween. Most preferably, angle N is approximately 45 degrees. By providing such a configuration, it is assured that any contents which remains in envelope 20 rests against either the front or rear face of envelope 20 as it is traveling in conveyor 12(see FIG. 7).

Thickness sensors 12 may take the form of optical sensors 22, which operate by measuring the transmissivity of light generated by a light source 24 through envelope 20 (and any contents of envelope 20). Thickness sensors 18 may alternately take the form of physical contact sensors 26, 28, acoustic sensors (not shown), or any of other numerous sensors, so long as the sensors can measure the thickness of the envelope 20 (and any contents thereof passing therebetween, and generate electrical signals indicative of such thickness. The electrical signals generated by thickness sensors 18 are transmitted to signal processor 30, the operation of which is discussed in detail below.

Figure 2:
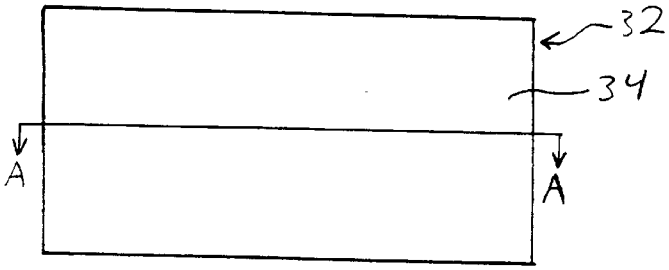
FIG. 2 is a plan view of the front surface of an envelope which can be tested using the system of FIG. 1.
Figure 3:
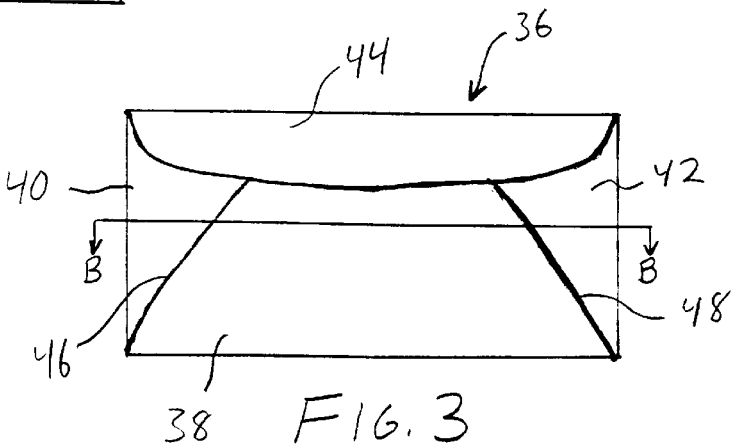
FIG. 3 is a plan view of the rear surface of an envelope which can be tested using the system of FIG. 1.
Figure 4:
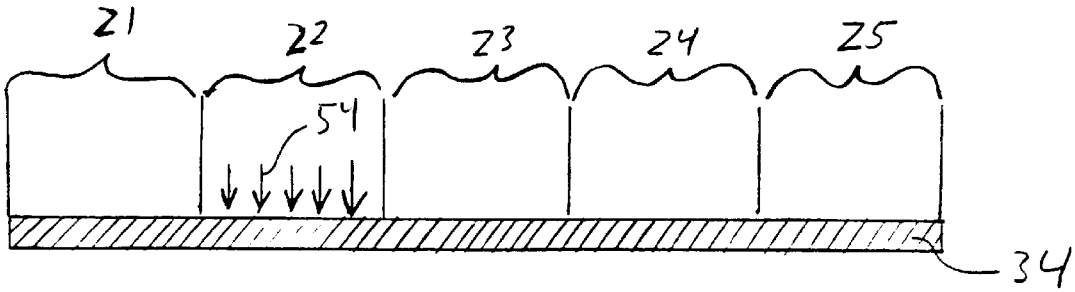
FIG. 4 is a partially cross-sectional view of the front surface of an empty envelope taken along line A—A of FIG. 2.
Figure 5:
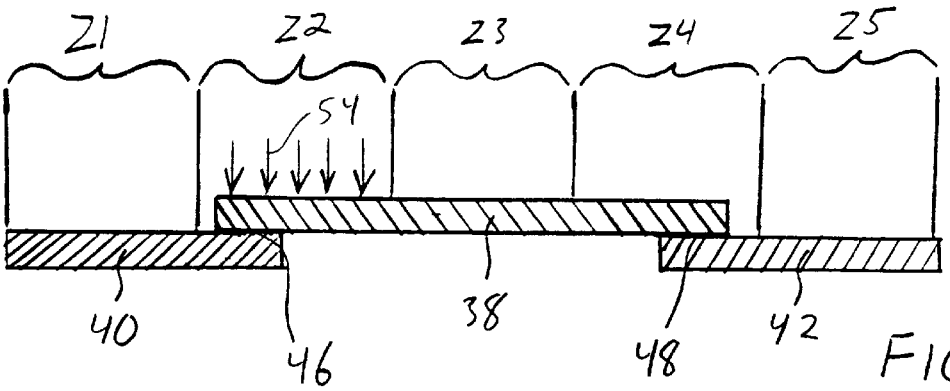
FIG. 5 is a partially cross-sectional view of the rear surface of an empty envelope taken along line B—B of FIG. 3.
Figure 7:
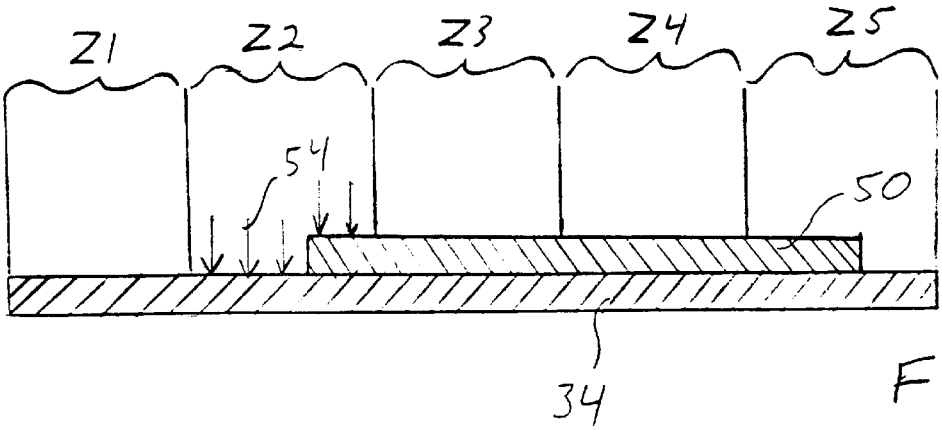
FIG. 7 is a partially cross-sectional view of the front surface of an envelope having contents remaining therein taken along line C—C of FIG. 6.
Figure 6:
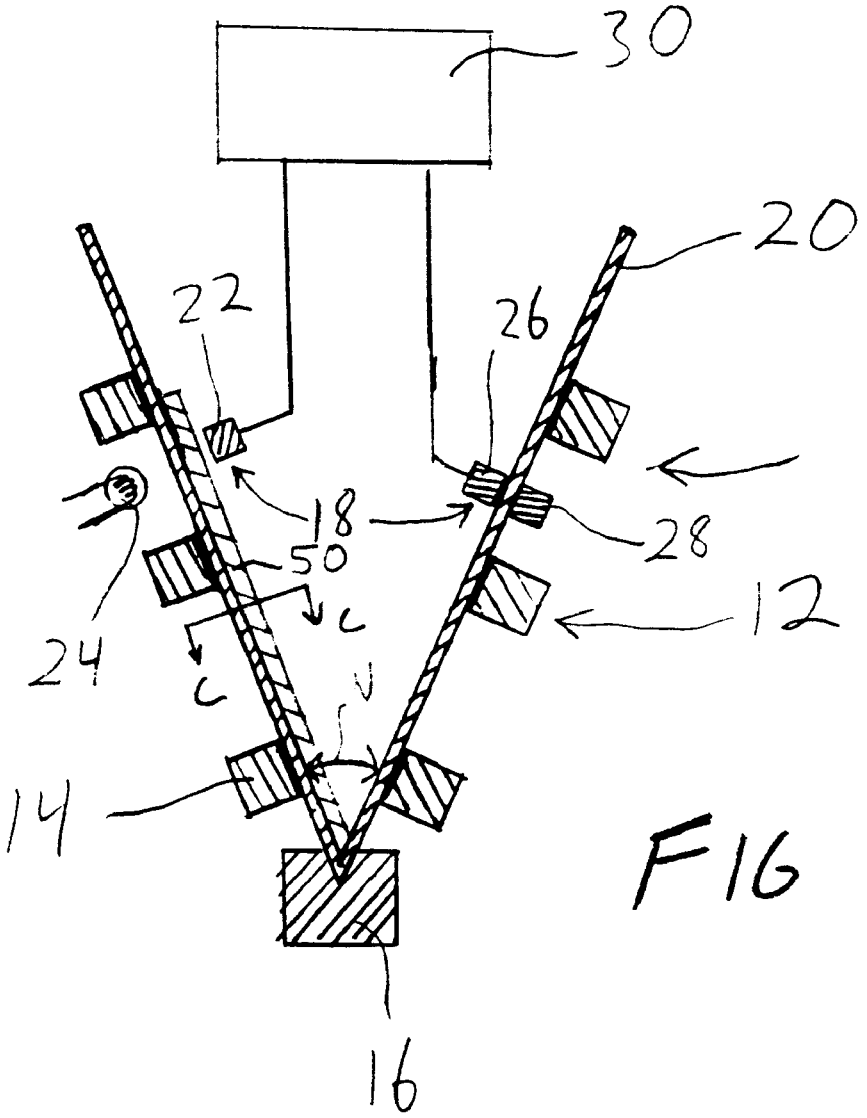
FIG. 6 is a partially cross-sectional view of an empty envelope assurance system of FIG. 1 having disposed therein an envelope with remaining contents.
Figure 8:
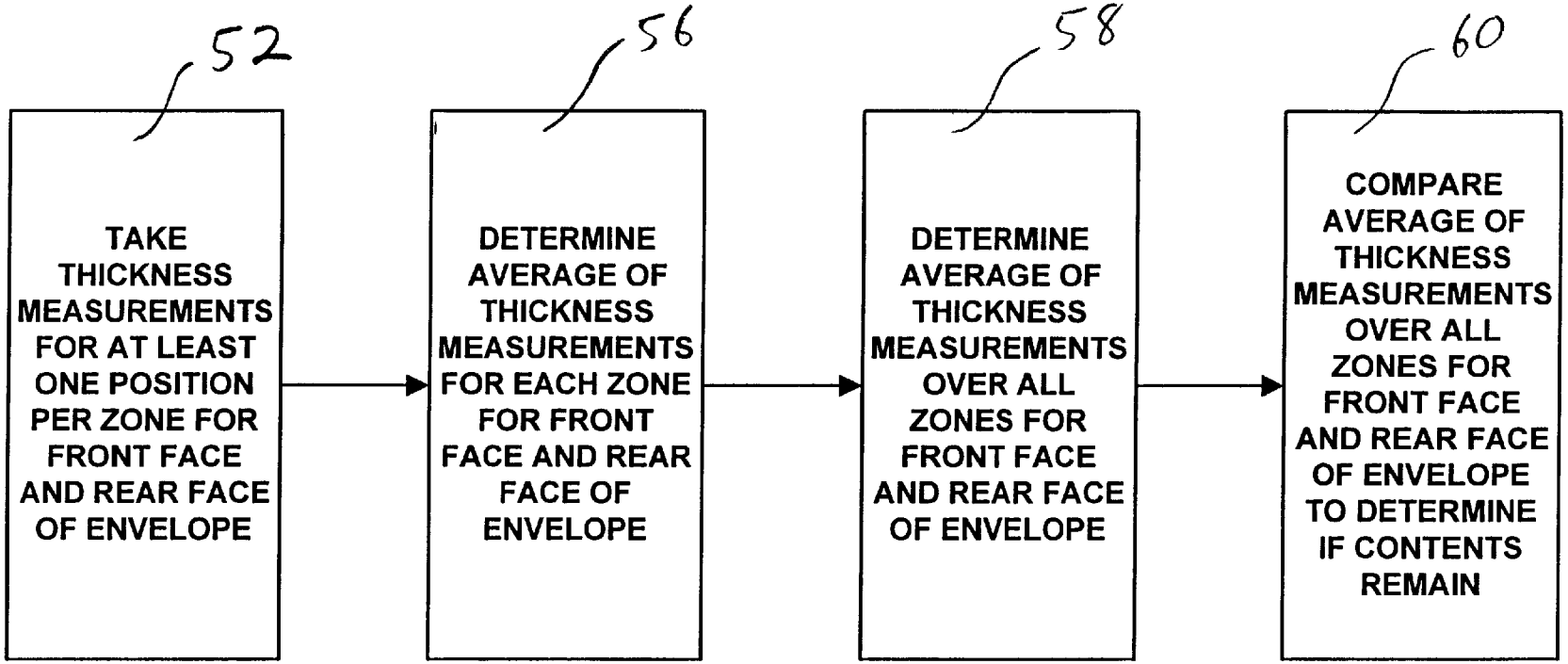
FIG. 8 is a block diagram illustrating operation of a signal processing portion of an empty envelope assurance system of FIG. 1.

Referring now to FIGS. 2 and 4, the front face 32 of a typical executive envelope 20 is shown. Front face 32 is made up of a single panel 34. Referring now to FIGS. 3 and 5, the rear face 36 of a typical executive envelope 20 is shown. Rear face 36 is made up of a lower panel 38, two side panels 40,42 and a flap 44. Side panels 40,42 overlap with lower panel 38 to define seams 46,48, which are typically glued together. Referring now to FIGS. 6 and 7, system 10 is shown having disposed therein an envelope 20 with contents 50 remaining therein leaning against a front face 34 of envelope 20.

Referring now to FIGS. 4–7 and 8, operation of signal processor 30 is shown in detail. As an envelope 20 enters system 10, preferably with each face of envelope 20 entering its respective thickness sensor 18 at the same time, signal processor 30 detects the leading edge of envelope 20 and begins the testing process. If desired, signal processor may begin a clock/timing circuit that allows a predetermined length of envelope 20 to pass through thickness sensors 18 before thickness measuring begins. The purpose of this is to allow for any end construction seams to pass through.

Each envelope 20 is viewed by signal processor 30 an being comprised of a plurality of test zones for front face 32 and rear face 36 of envelope 20. Five of such test zones Z1,Z2,Z3,Z4,Z5 are shown in the Figures. At 52, signal processor 30 takes thickness measurements for at least one position per zone for each of the front face 32 and rear face 36 of envelope 20. Preferably signal processor 30 includes software adjustable parameters for setting the length of envelope 20 to be inspected, the number of zones, and the number of inspections to be made per zone. At a minimum, one inspection is to be made per zone, with more being preferred to increase reliability. Five inspections for zone Z2 are illustrated in the Figures by arrows 54.

Once all measurements have been taken, signal processor 30, at 56, averages the measurements taken at each zone. Obviously, if only one measurement was taken at each zone, an averaging will not be necessary at this stage. Sample results for the average measurement of each zone are shown for a front face 32 of an empty envelope 20 (corresponding to FIG. 4), a rear face 36 of an empty envelope 20 (corresponding to FIG. 5), and a front face 32 of an envelope 20 having contents 50 remaining therein (corresponding to FIG. 7) in Table 1. In each block of Table 1, the number represents sensor output (usually expressed in volts).

TABLE 1

| | Z1 | Z2 | Z3 | Z4 | Z5 |
|---|---|---|---|---|---|
| Front Face Empty (FIG. 4) | 3.0 | 3.0 | 3.0 | 3.0 | 3.0 |
| Rear Face Empty (FIG. 5) | 3.0 | 2.25 | 3.0 | 2.25 | 3.0 |
| Front Face w/ Contents (FIG. 7) | 3.0 | 2.25 | 1.5 | 1.5 | 2.0 |

As will be noted from Table 1, rear face 36 includes construction seams 46, 48 in zones Z2 and Z4, which are detected as an extra thickness, thereby reducing the average sensor readings for those zones. Because the readings for each zone are averaged, however, the effect of the construction seams is minimized in comparison to the case where the entire zone contains an extra layer of paper. It will also be noted that in the case of a front face 32 of an envelope 20 having contents 50 remaining therein (corresponding to FIG. 7), contents 50 cover all of zones Z3 and Z4, thereby reducing the average sensor readings for those zones to a greater extent than zones Z2 and Z5 which are only partially covered.

Signal processor 30 then, at 58, determines the average thickness measurements over all zones for front face 32 and rear face 36 of envelope 20. In the example presented above in Table 1, the average reading over all zones for a front face 32 of an empty envelope 20 (corresponding to FIG. 4) is 3.0, for a rear face 36 of an empty envelope 20 (corresponding to FIG. 5) is 2.7, and a front face 32 of an envelope 20 having contents 50 remaining therein (corresponding to FIG. 7) is 2.05.

At 60, signal processor 30 compares the average thickness measurement value over all zones for front face 32 and rear face 36 of envelope 60 to determine if contents remain therein. This is accomplished by determining whether the two values correspond within a predetermined limit. Using the above example, signal processor compares average measurement of the front face, 3.0, to the average measurement of the rear face, 2.7, to determine that the difference is 0.3. Signal processor determines if such a 0.3 difference from the front face to the rear face is within the predetermined limit. In this example, assume the predetermined limit has been set to 0.5. It should be noted that the predetermined limit is preferably variable by the user of the system. Thus, 0.3 is acceptable, and signal processor 30 determines that the envelope is empty (i.e., the material composing the front face is the same material composing the rear face, with no additional material at either face). On the other hand, if the average measurement of the front face is 2.05 and the average measurement of the rear face is 2.7, then signal processor 30 determines that the difference is 0.65. As this value is above the predetermined limit of 0.5, signal processor 30 determines that the envelope has contents remaining therein (i.e., the material composing the front face is not the same material composing the rear face—additional material is present at either the front face or the rear face).

It should be noted that at no time does signal processor 30 compare any readings to any constant threshold value. The measurement values of the front face are compared to those of the rear face to provide relative comparison therebetween, without comparison to some reference or ideal envelope. This allows for the effective and efficient processing of "white" mail, consisting of envelopes that are inconsistent in style, color, and size.

Preferably, in the event that during envelope inspection sensors 18 encounter a window (i.e., a transparent or highly translucent section) in one of the envelope faces, signal processor 30 will be able to disregard such zones that are detected as being "open" when the opposing face generated a reading for the same zone. This will inhibit erroneous findings of enveloped having contents therein when one face has such a window and the other does not, thereby causing a large difference in average thickness measurements from the front face to the rear face.

The present invention, therefore, provides an empty envelope assurance system which determines whether all of the contents of an envelope have been removed, which can be used to effectively and efficiently process white mail having envelopes that are inconsistent in style, color, and size, and which is dependent upon the characteristics of the envelope itself rather than predetermined threshold values or constants.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An empty envelope assurance system comprising:

a conveyor for conveying an opened envelope having a front face and a rear face along a path of movement, said conveyor arranged such that any contents of the envelope rests against one of the front face or the rear face;

a first sensor for measuring a thickness of the front face and any contents resting thereagainst, and for generating a signal having a value indicative of the thickness;

a second sensor for measuring a thickness of the rear face and any contents resting thereagainst, and for generating a signal having a value indicative of the thickness; and a signal processor for receiving the signals generated by said first sensor and said second sensor, and for comparing the values of the signals generated by said first sensor with the values of the signals generated by said second sensor to determine whether they correspond within a predetermined limit to determine whether the envelope contains any contents.

2. The system of claim 1:

wherein the front face and the rear face of the envelope each define a plurality of zones;

wherein said first sensor measures a thickness of the front face and any contents resting thereagainst at each zone, and generates a signal having a value indicative of the thickness at each zone; and wherein said second sensor measures a thickness of the rear face and any contents resting thereagainst at each zone, and generates a signal having a value indicative of the thickness at each zone.

3. The system of claim 2 wherein said signal processor averages the values of the zones of the front face to determine a value indicative of the thickness of the front face and averages the values of the zones of the rear face to determine a value indicative of the thickness of the rear face, and compares the value indicative of the thickness of the front face with the value indicative of the thickness of the rear face to determine whether they correspond within a predetermined limit to determine whether the envelope contains any contents.

4. The system of claim 2:

wherein said first sensor measures a thickness of the front face and any contents resting thereagainst at a plurality of locations in each zone, and generates a signal having a value indicative of the thickness at each location;

wherein said second sensor measures a thickness of the rear face and any contents resting thereagainst at a plurality of locations in each zone, and generates a signal having a value indicative of the thickness at each location; and wherein said signal processor receives the signals generated by said first sensor and said second sensor, averages the values of the signals generated by said first sensor at each location to determine an average value indicative of the thickness at each zone of the front face and averaging the values of the signals generated by said second sensor at each location to determine an average value indicative of the thickness at each zone of the rear face, and compares the average values indicative of the thickness at each zone of the front face with the average values indicative of the thickness at each zone of the rear face to determine whether they correspond within a predetermined limit to determine whether the envelope contains any contents.

5. The system of claim 1 wherein said first sensor and said second sensor comprise optical sensors.

6. The system of claim 1 wherein said first sensor and said second sensor comprise contact sensors.

7. The system of claim 1 wherein said first sensor and said second sensor comprise acoustic sensors.

8. An empty envelope assurance system comprising:

a conveyor for conveying an opened envelope having a front face and a rear face along a path of movement, the front face and the rear face of the envelope each define a plurality of zones, and said conveyor arranged such that any contents of the envelope rests against one of the front face or the rear face;

a first sensor for measuring a thickness of the front face and any contents resting thereagainst at each zone, and for generating a signal having a value indicative of the thickness at each zone;

a second sensor for measuring a thickness of the rear face and any contents resting thereagainst at each zone, and for generating a signal having a value indicative of the thickness at each zone;

a signal processor for receiving the signals generated by said first sensor and said second sensor, for averaging the values of the zones of the front face to determine a value indicative of the thickness of the front face and averaging the values of the zones of the rear face to determine a value indicative of the thickness of the rear face, and for comparing the value indicative of the thickness of the front face with the value indicative of the thickness of the rear face to determine whether they correspond within a predetermined limit to determine whether the envelope contains any contents.

9. The system of claim 8:

wherein said first sensor measures a thickness of the front face and any contents resting thereagainst at a plurality of locations in each zone, and generates a signal having a value indicative of the thickness at each location;

wherein said second sensor measures a thickness of the rear face and any contents resting thereagainst at a plurality of locations in each zone, and generates a signal having a value indicative of the thickness at each location;

said signal processor, before averaging the values of the zones of the front face to determine a value indicative of the thickness of the front face and averaging the values of the zones of the rear face to determine a value indicative of the thickness of the rear face, averages the values of the signals generated by said first sensor at each location to determine an average value indicative of the thickness at each zone of the front face and averages the values of the signals generated by said second sensor at each location to determine an average value indicative of the thickness at each zone of the rear face.

10. The system of claim 8 wherein said first sensor and said second sensor comprise optical sensors.

11. The system of claim 8 wherein said first sensor and said second sensor comprise contact sensors.

12. The system of claim 8 wherein said first sensor and said second sensor comprise acoustic sensors.

13. An empty envelope assurance system comprising:

a conveyor for conveying an opened envelope having a front face and a rear face along a path of movement, the front face and the rear face of the envelope each define a plurality of zones, and said conveyor arranged such that any contents of the envelope rests against one of the front face or the rear face;

a first sensor for measuring a thickness of the front face and any contents resting thereagainst at a plurality of locations in each zone, and generating a signal having a value indicative of the thickness at each location;

a second sensor for measuring a thickness of the rear face and any contents resting thereagainst at a plurality of locations in each zone, and generating a signal having a value indicative of the thickness at each location;

a signal processor for receiving the signals generated by said first sensor and said second sensor, for averaging the values of the signals generated by said first sensor at each location to determine an average value indicative of the thickness at each zone of the front face and averaging the values of the signals generated by said second sensor at each location to determine an average value indicative of the thickness at each zone of the rear face, for averaging the values of the zones of the front face to determine a value indicative of the thickness of the front face and averaging the values of the zones of the rear face to determine a value indicative of the thickness of the rear face, and for comparing the value indicative of the thickness of the front face with the value indicative of the thickness of the rear face to determine whether they correspond within a predetermined limit to determine whether the envelope contains any contents.

14. The system of claim 13 wherein said first sensor and said second sensor comprise optical sensors.

15. The system of claim 13 wherein said first sensor and said second sensor comprise contact sensors.

16. The system of claim 13 wherein said first sensor and said second sensor comprise acoustic sensors.

17. A method for empty envelope assurance comprising the steps of:

conveying an opened envelope having a front face and a rear face along a path of movement in such a manner that any contents of the envelope rests against one of the front face or the rear face;

measuring a thickness of the front face and any contents resting thereagainst, and generating a signal having a value indicative of the thickness with a first sensor;

measuring a thickness of the rear face and any contents resting thereagainst, and generating a signal having a value indicative of the thickness with a second sensor; and comparing the values of the signals generated by the first sensor with the values of the signals generated by the second sensor to determine whether they correspond within a predetermined limit to determine whether the envelope contains any contents.

18. The method of claim 17:

wherein the front face and the rear face of the envelope each define a plurality of zones;

wherein said measuring a thickness of the front face step comprises the step of measuring a thickness of the front face and any contents resting thereagainst at each zone, and generating a signal having a value indicative of the thickness at each zone; and wherein said measuring a thickness of the rear face step comprises the step of measuring a thickness of the rear face and any contents resting thereagainst at each zone, and generating a signal having a value indicative of the thickness at each zone.

19. The method of claim 18 wherein said comparing step comprises the steps of:

averaging the values of the zones of the front face to determine a value indicative of the thickness of the front face;

averaging the values of the zones of the rear face to determine a value indicative of the thickness of the rear face; and comparing the value indicative of the thickness of the front face with the value indicative of the thickness of the rear face to determine whether they correspond within a predetermined limit to determine whether the envelope contains any contents.

20. The method of claim 18:

wherein said measuring a thickness of the front face step comprises the step of measuring a thickness of the front face and any contents resting thereagainst at a plurality of locations in each zone, and generating a signal having a value indicative of the thickness at each location;

wherein said measuring a thickness of the rear face step comprises the step of measuring a thickness of the rear face and any contents resting thereagainst at a plurality of locations in each zone, and generating a signal having a value indicative of the thickness at each location; and wherein said comparing step comprises the steps of:

averaging the values of the signals generated by the first sensor at each location to determine an average value indicative of the thickness at each zone of the front face;

averaging the values of the signals generated by the second sensor at each location to determine an average value indicative of the thickness at each zone of the rear face; and comparing the average values indicative of the thickness at each zone of the front face with the average values indicative of the thickness at each zone of the rear face to determine whether they correspond within a predetermined limit to determine whether the envelope contains any contents.

21. A method for empty envelope assurance comprising the steps of:

conveying an opened envelope having a front face and a rear face along a path of movement, the front face and the rear face of the envelope each defining a plurality of zones, and the conveyor arranged such that any contents of the envelope rests against one of the front face or the rear face;

measuring a thickness of the front face and any contents resting thereagainst at a plurality of locations in each zone, and generating a signal having a value indicative of the thickness at each location with a first sensor;

measuring a thickness of the rear face and any contents resting thereagainst at a plurality of locations in each zone, and generating a signal having a value indicative of the thickness at each location with a second sensor;

averaging the values of the signals generated by the first sensor at each location to determine an average value indicative of the thickness at each zone of the front face and averaging the values of the signals generated by the second sensor at each location to determine an average value indicative of the thickness at each zone of the rear face;

averaging the values of the zones of the front face to determine a value indicative of the thickness of the front face and averaging the values of the zones of the rear face to determine a value indicative of the thickness of the rear face; and comparing the value indicative of the thickness of the front face with the value indicative of the thickness of the rear face to determine whether they correspond within a predetermined limit to determine whether the envelope contains any contents.

* * * * *